United States Patent [19]

Swift

[11] 4,287,280

[45] Sep. 1, 1981

[54] RELEASE AGENT APPLICATORS AND METHOD OF APPLYING RELEASE AGENT EMULSIONS UPON FUSERS IN ELECTROSTATIC COPIERS

[75] Inventor: Joseph A. Swift, Ontario, N.Y.

[73] Assignee: Xerox Corporation, Stamford, Conn.

[21] Appl. No.: 52,385

[22] Filed: Jun. 27, 1979

[51] Int. Cl.[3] ..... B44D 1/094; G03G 13/20; G03G 15/20; B05C 11/00

[52] U.S. Cl. ..... 430/99; 118/60; 118/70; 118/260; 118/264; 427/350; 427/387; 427/429; 430/124; 432/60

[58] Field of Search ..... 118/60, 266, 110, 70, 118/260, 264; 427/194, 387, 350, 401, 429; 428/906; 432/60, 59, 228; 430/99, 124

[56] References Cited

U.S. PATENT DOCUMENTS

| | | | |
|---|---|---|---|
| 3,256,002 | 6/1966 | Hudson | 263/3 |
| 3,645,615 | 2/1972 | Spear | 355/3 |
| 3,846,151 | 11/1974 | Roteman et al. | 427/194 X |
| 3,987,530 | 10/1970 | Atkin et al. | 427/350 X |
| 4,000,957 | 1/1977 | Ruhland | 427/194 X |
| 4,065,585 | 12/1977 | Jelfo et al. | 427/194 X |
| 4,065,586 | 12/1977 | Eddy et al. | 427/194 X |
| 4,075,390 | 2/1978 | Murphy | 427/194 X |
| 4,083,322 | 4/1978 | Beckman | 118/60 X |
| 4,085,702 | 4/1978 | Consaul et al. | 118/60 |
| 4,149,797 | 4/1979 | Imperial | 355/3 FU |

FOREIGN PATENT DOCUMENTS

| | | |
|---|---|---|
| 2346749 | 10/1977 | France . |
| 1399740 | 7/1975 | United Kingdom . |

OTHER PUBLICATIONS

*Analysis of Silicones,* Smith, A. Lee, 1974, pp. 170–176.

*Primary Examiner*—Michael R. Lusignan

[57] ABSTRACT

Offset of toner powder upon a heated surface is prevented by applying an emulsion of a high viscosity release agent and a low viscosity dispersion liquid upon the heated surface by an applicator means in contact with the heated surface. The preferred emulsion is a mixture of high viscosity silicone oil and water. There is also described a method of manufacturing a fibrous applicator and the article formed thereby which includes the impregnation of the fibrous applicator with an emulsion of high viscosity liquid and a low viscosity dispersion liquid and the removal of low viscosity dispersion liquid after impregnation with the emulsion is complete. A preferred applicator is a fibrous wick having water removed therefrom after the fibrous wick is impregnated with an emulsion of a polydimethylsiloxane liquid and water.

28 Claims, 2 Drawing Figures

RELEASE AGENT APPLICATORS AND METHOD OF APPLYING RELEASE AGENT EMULSIONS UPON FUSERS IN ELECTROSTATIC COPIERS

BACKGROUND OF THE INVENTION

This invention relates to the application of high viscosity release agents upon the surfaces of heated members, and more particularly, to the application of high viscosity release agents upon the surfaces of a fuser member in xerographic copying machines. The invention also relates to the method of manufacture of certain preferred applicators and the article formed thereby.

The present invention is particularly useful in the field of xerography where images are electrostatically formed upon a member and developed with resinous powders known as toners, and thereafter fused or fixed onto sheets of paper or other substrates to which the powder images have been transferred. The resin-based powders or toners are generally heat and/or pressure softenable, such as those provided by toners which contain thermoplastic resins and used conventionally in a variety of commercially known methods.

In order to fuse images formed of the resinous powders or toners, it is necessary to heat the powder, to submit the powder to pressure or to use a combination of heat and pressure to fix or fuse the resinous powders or toners to a particular substrate. Temperature ranges and/or pressure will vary depending upon the softening range of the particular resin used in the toner. When heat is used in conjunction with pressure to fuse the images to a substrate, it is generally necessary to heat the toner powder in excess of about 93° C. or higher. Temperatures as high as 163° C. or even higher are not uncommon in commercially known methods and devices.

It has long been recognized that one of the fastest and most positive methods of applying heat for fusing the powder image is direct contact of the resin-based powder with a hot surface, such as a heated roll while pressure is being applied to the substrate to which the powder image is to be fused or fixed. But, in most instances, as the powder image is tackified by the heat and/or pressure, part of the image carried by the support material will stick to the surface of the plate or roll or any other configuration so that as the next sheet is advanced on the heated surface, the tackified image, partially removed from the first sheet, will partly transfer to the next sheet and at the same time part of the tackified image from said next sheet would adhere to the heated surface. This process is commonly referred to in the art as "offset," a term well-known in the art.

The offset of toner onto the heated surface led to the development of improved methods and apparatus for fusing the toner image. These improvements comprised fusing toner images by forwarding the sheet or web of substrate material bearing the image between two rolls at least one of which was heated, the rolls contacting the image being provided with a thin coating of tetrafluoroethylene resin and a silicone oil film to prevent toner offset. The outer surfaces of such rolls have also been fabricated of fluorinated ethylene/propylene or silicone elastomers coated with silicone oil as well as silicone elastomers containing low surface energy fillers such as fluorinated organic polymers, and the like. The tendency of these rolls to pick up the toner generally requires some type of release fluid continuously applied to the surface of the roll to prevent such offset, and commonly known silicone oils are generally well adapted for this purpose. Not only are the polydimethyl-siloxane fluids well known for this purpose but certain functional polyorganosiloxane release agents have also been described for this purpose. It is also well known to utilize fluids of low viscosity, for example, 100–200 centistokes as well as fluids of relatively high viscosity, for example, 12,000 centistokes to 60,000 centistokes and higher.

It is advantageous to use release fluids, liquids or agents of relatively high viscosities to prevent the offset phenomenon in certain applications. For example, in certain high speed duplicators and copiers, there is substantial improvement of fuser performance when high viscosity release agents are applied upon the heated surfaces used to fix the toner powders to a substrate when the substrate is in pressure engagement with the heated surface. However, because of the high viscosity of the fluids, substantial difficulty is encountered in applying the fluids upon the surfaces of the fuser members. It is for this reason that emulsions of water and high viscosity silicone oil have been atomized and sprayed upon the fuser roll as disclosed in French Pat. No. 2,346,749. The water in such emulsions evaporates when it is atomized upon the fuser roll. Furthermore, this prior art teaches that such applicator devices as wicks and pads require the use of low viscosity release fluids for the effective application of a release agent upon a heated surface used to fix toner powder to a substrate.

OBJECTS OF THE INVENTION

Accordingly, the principal object of this invention is to provide a new and improved method for applying a high viscosity release fluid upon the surface of a fuser member in a copying or duplicating apparatus.

It is another object of this invention to provide a new and improved heat resistant, fibrous applicator for the contact application of high viscosity fluid upon the surface of a heated member whereby the difficulty in applying the high viscosity liquid upon the surface is eliminated.

It is another object of the present invention to provide a method of manufacturing a heat resistant, fibrous applicator for the contact application of fluid upon the surface of a heated member.

SUMMARY OF THE INVENTION

These and other objects of the invention are obtained by providing means for applying pressure contact between a substrate bearing a toner powder and a heated surface; applicator means in contact with the heated surface for providing a high viscosity release agent upon the heated surface, the applicator means bearing a low viscosity emulsion of the high viscosity release agent and an inert dispersion liquid; and means for removing the inert dispersion liquid from the low viscosity emulsion. In accordance with the present invention, there is also provided a method for preventing the offset of toner powder to a surface used to fix toner powder to a substrate comprising applying to the surface a high viscosity release agent liquid by applicator means in contact with the heated surface, said applicator means containing a low viscosity emulsion of high viscosity release agent and a vaporizable dispersion liquid. The vaporizable dispersion liquid permits the transport of the high viscosity release agent liquid from the applicator means to the surface used to fix the toner powder to the substrate.

The preferred applicator means in contact with the surface used to fix the toner powder to a substrate is a heat resistant, fibrous applicator. In accordance with the present invention, there is also provided a method of manufacturing a heat resistant, fibrous applicator for the contact application of fluid upon the surface used to fix toner powder to a substrate comprising forming the applicator in the desired configuration and thickness; applying an emulsion of a high viscosity liquid and a low viscosity dispersion liquid to the applicator until the emulsion is impregnated therein; and optionally removing low viscosity dispersion liquid therefrom. In accordance with the present invention, there is also provided an article comprising a heat resistant, fibrous applicator for the contact application of fluid upon a surface used to fix toner powder to a substrate, the fibrous applicator being impregnated with an emulsion of a high viscosity liquid and a dispersion liquid and thereafter reduced of dispersion liquid.

As used herein, the surface used to fix toner powder to a substrate is generally a heated surface, and the substrate to which the toner powder is fixed or fused is placed in pressure engagement with the heated surface. As used herein, the surface or heated surface may be a roll, a flat surface, or plate or any other shape suitable for fixing toner powder or resin-based powder images to a substrate.

Further objects of this invention together with additional features and advantages thereof will become apparent from the following detailed description of the preferred embodiments of the invention when read in conjunction with the accompanying drawings.

DESCRIPTION OF THE PREFERRED EMBODIMENTS

For purpose of the present disclosure and exemplary of a typical utility for the device for heat fusing toner powder to a substrate by contacting the toner powder with a heated surface, there is set forth below a brief description of an automatic xerographic reproduction machine in which the device for heat fusing the toner powder is one of several processing stations in the path of movement of a photoconductive plate. The plate has a photoconductive layer or light receiving surface on a conductive backing and is journaled in a frame to rotate. The rotation causes the cylindrical plate surface to pass sequentially through a series of xerographic processing stations which may be described functionally as follows.

A uniform electrostatic charge is deposited upon the photoconductive drum at a charging station. A light or radiation pattern of a document to be reproduced is projected onto the plate surface to dissipate the charge in the exposed areas to form a latent electrostatic image of the document to be reproduced at an exposure station. Thereafter, a xerographic developing material referred to herein as a toner powder, including toner particles having an electrostatic charge opposite to that of the latent electrostatic image is cascaded or brushed over the latent electrostatic image to form a powdered image in configuration of the document being reproduced. This is referred to as a developing station.

Figure 1:
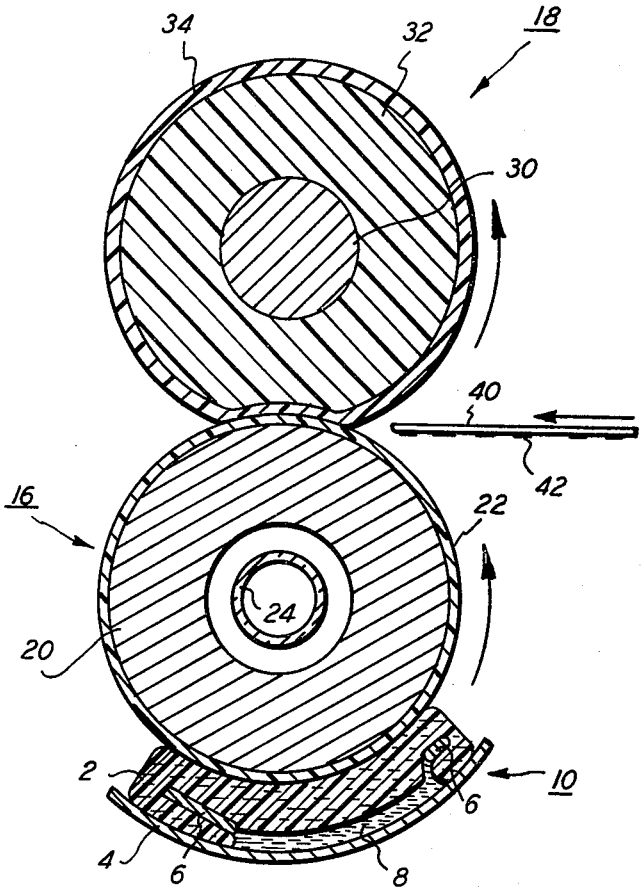
FIG. 1 is a sectional view of a typical fusing apparatus including fuser roll, pressure roll, and fibrous applicator means of the present invention.

Following development, the powdered image is electrically transferred from the plate surface to a transfer material such as paper, referred to herein as a substrate. This station is typically referred to as a transfer station. The transfer material (substrate) bearing the powdered image is then passed through a heated pressure fusing apparatus which is exemplified by the device of FIG. 1. This station is normally referred to as a fusing station. The device of FIG. 1 illustrates the improved applicator means in contact with the heated surface of the fuser roll in accordance with the present invention.

For further details of the xerographic processing stations described above, reference is made to U.S. Pat. Nos. 3,645,615 and 4,149,797.

In accordance with the present invention, one of the preferred embodiments embraces an applicator means in contact with a surface used to fix toner powder to a substrate, the applicator containing an emulsion of high viscosity release agent and dispersion liquid. The emulsions are disclosed in the prior art and are commercially available compositions. The low viscosity emulsion serves as a vehicle to transport high viscosity release agent contained therein in an emulsified state with the dispersion liquid into and/or through an applicator means to the surface used to fix toner powder to a substrate. The release agent is applied to the surface used to fix the toner powder to the substrate to prevent the offset phenomenon discussed above.

Although the invention is applicable to almost any type of surface which may be used in fixing or fusing a resin-based or toner powder image, for convenience, descriptions set forth herein are directed to fuser roll members which are substantially cylindrical in shape. However, the fuser members may also have a flat surface, or they may be in the form of a plate, or they may assume any type of suitable configuration.

The construction of the fuser roll members of the present invention is not critical, and they may have metal surfaces, rubber or elastomer surfaces, or resin-coated surfaces. The applicator means in contact with the surface used to fix toner powder to a substrate in accordance with the present invention is applicable to any fuser member regardless of the construction and composition of the surface.

The emulsion compositions comprising a high viscosity release agent and a dispersion liquid are not the inventive feature of the present invention, however, it is these emulsions which are applied to the heated surface used to fix toner powder to a substrate to prevent the offset of toner powder to the surface by applicator means in contact with the heated surface. The applicator means in contact with the heated surface contains the emulsion. Furthermore, it is the emulsion of the high viscosity liquid and the low viscosity dispersion liquid which is impregnated in the heat resistant, fibrous applicator in the method of manufacturing wherein optionally at least a part of the low viscosity dispersion liquid is removed from the emulsion within the applicator during the method of manufacture. The article prepared by this method comprises a heat resistant, fibrous applicator for the contact application of fluid upon the surface of a heated member, the fibrous applicator being impregnated with an emulsion of a high viscosity liquid and a dispersion liquid and thereafter optionally reduced of dispersion liquid.

Exemplary emulsion compositions which may be used in accordance with the present invention are described in French Pat. No. 2,346,749. Examples of these emulsions are a silicone oil-water emulsion having an approximate kinematic viscosity of $10^{-2}$ $m^2$/sec. supplied by General Electric Company under the trade designation of SM-2040 and a silicone oil-water emulsion having an approximate kinematic viscosity of $10^{-1}$ $m^2$/sec. supplied by Dow Corning Company under the trade designation HV-490. In these particular emulsions, the dispersion liquid is water. In the present invention, the dispersion liquid (water) vaporizes at the temperature of the surface of the fuser member leaving behind only the high viscosity release agent. In general, the high viscosity release agent, for example, silicone oil, is emulsified with only that amount of dispersion liquid or medium, for example, water, necessary to improve handling ability and appropriate transport of the high viscosity silicone oil into and/or through the applicator member or means. Thus, the low viscosity emulsion is made of a high viscosity release agent liquid containing a sufficient amount of low viscosity dispersion liquid to improve the handling ability and the transport of the high viscosity release agent liquid or fluid to and/or through the applicator means to the heated surface of the fuser member. Certain well-known hard emulsions such as methyl silsesquioxane ($CH_3SiO_{3/2}$) emulsions and silicone-acrylic emulsions may also be used in accordance with the present invention. "Hard emulsions" are those wherein the particles retain their size and shape after evaporation of the dispersing medium or liquid.

Thus, by a sufficient amount of dispersion liquid, is meant that amount of dispersion liquid which reduces the viscosity of the high viscosity release agent liquid to promote the flow of the high viscosity release agent liquid to the applicator means and/or to transport the high viscosity release agent liquid through the applicator member to the heated surface used to fix toner powder to a substrate and/or to cause the impregnation of the high viscosity release agent liquid in the heat resistant, fibrous applicator. In preferred embodiments, the amount of dispersion liquid present in the emulsion is that amount which reduces the viscosity of the high viscosity release agent liquid, for example, a polydimethylsiloxane, by about 50% to about 99.9% and most preferably by at least 75%. In most preferred embodiments, the amount of dispersion liquid present in the emulsion is that amount which reduces the viscosity of the high viscosity release agent to less than about 100 centistokes and preferably to about 10 to 50 centistokes.

The dispersion liquid, preferably water, used in the emulsion, must be vaporizable, that is, it must be vaporized at the temperatures of the heated surface of the fuser member which is generally in excess of about 100° C., or it must be vaporizable at pressures less than atmospheric (vacuum), or it must be vaporizable at elevated temperatures and reduced pressures combined without causing any significant degradation, crosslinking or curing of the high viscosity release agent liquid. The dispersion liquid must also be a non-solvent for the release agent liquid.

Although water is generally the most preferred dispersion liquid for forming the emulsions with release agent liquids in accordance with the present invention because it is relatively volatile, non-flammable, inert and a non-solvent for most commonly known release agent liquids, other dispersion liquids may also be used. Cyclohexanol and the hydrocarbon alcohols such as methanol, ethanol, propanol, isopropanol and butanol, may also be used as dispersion liquids, but because of the flammable nature of these liquids, they are recommended for use in the manufacture of heat resistant, fibrous applicators wherein the low viscosity dispersion liquid is removed therefrom before the applicator is placed in or used in a fusing device at elevated temperatures. As used herein, dispersion liquid or dispersion medium may be used interchangeably, and represents the carrier or transport medium in which the high viscosity release agent fluid (usually an oil) is emulsified.

The invention is not limited to any particular high viscosity release agent liquid and includes the polydimethylsiloxane (silicone) oils, the functional polyorganosiloxane oils such as mercapto-functional polyorganosiloxane, fluorocarbon oils, fluorosilicone oils and the like. Any conventional release agent fluid (oil) may be used in the emulsions of the present invention.

As used herein, high viscosity release agent liquid or high viscosity oil refers to a liquid or oil having a viscosity of at least 10,000 centistokes and generally specifies a range of release agent liquids from about 10,000 centistokes to about 100,000 centistokes. The dispersion liquid which is vaporizable, is added to the high viscosity release agent fluid to reduce substantially the viscosity thereof, preferably to reduce the viscosity by one half of its original value. For example, by forming an emulsion of a 40% silicone oil having a viscosity of 60,000 centistokes with 60% water results in an emulsion having a viscosity of about 15 centistokes. It is this resultant viscosity, that is, the viscosity of the emulsion wherein the dispersion liquid cuts the viscosity of the release agent 50%, and more preferably by greater than 50%, which is referred to herein as a low viscosity emulsion.

After the removal of the dispersion liquid by heat, by reduced pressure or by a combination of heat and reduced pressure, the high viscosity release agent fluid fraction or portion of the emulsion remains in the impregnated article and/or upon the heated surface of the fuser member and/or upon or near the surface of the applicator means in contact with the heated surface of the fuser member.

The emulsion used in the applicator member of the present invention may also contain other ingredients which do not effect the action of the release agent liquid in reducing offset, which does not interfere with or reduce copy quality, which does not cause any adverse reaction within the release agent liquid and which does not corrode or otherwise harm the elements and members of the fuser device and related parts. As used herein, inert is used to define those dispersion liquids and high viscosity release agents which do not have any of the foregoing adverse effects or reactions.

Referring to FIG. 1, there is shown a typical heated pressure fusing apparatus which includes the improved applicator means 10 which contains the emulsion of the high viscosity release agent liquid and dispersion liquid. The heated pressure fusing apparatus includes a heated fuser roll 16 and a backup or pressure roll 18. The fuser roll is a hollow circular cylinder including a metallic core 20 which is covered with a layer 22, for example, a layer of Teflon or a layer of Viton (both trademarks of E. I. duPont deNemours and Company of Wilmington, Del.), silicone elastomer, copolymer of perfluoroalkyl perfluorovinyl ether with tetrafluoroethylene or other suitable materials known in the art. A quartz lamp 24 located inside of the fuser roll is a source of thermal energy for the fusing apparatus. The pressure or backup roll is also a cylinder and is made of a metal core 30 surrounded by a thick organic rubber layer 32 and then by another layer 34 made of Teflon or other suitable material to prevent the permeation of air into the layer 32 and subsequent oxidation degradation thereof.

The particular manner in which the fuser roll structure 16 and the pressure roll structure 18 are fabricated, forms no part of the present invention. Accordingly, such fabrication thereof may be in accordance with well-known processes and may even include fuser members having bare metal surfaces as well known in the art. While the fuser structure is disclosed as having a resinous or elastomeric layer, it may be fabricated without the layer and may simply comprise a bare metal surface.

When the two rollers 16 and 18 are engaged as shown in FIG. 1, the applied load deforms the pressure roll to provide the nip with a finite width. In other instances (not shown), the pressure roll may be hard and the fuser roll may be soft thereby deforming the surface of the fuser roll to provide a nip with a finite width. In FIG. 1, a copy sheet 40 electrostatically bearing toner images 42 on the underside is brought into contact with the nip of the rolls and with the toner images contacting the fuser roll surface. The mechanism for driving the rolls and for lowering and raising rolls into contact can be accomplished by any suitable means well known in the art for example, by mechanical camming devices. As the sheet of material 40 advances between rolls 16 and 18, toner images 42 are contacted by the peripheral heated surface of roll 16 causing the toner image to become tackified which tends to cause the toner to offset onto the roll except that it is prevented from doing so by the coating upon the surface of the roll (22) and/or by the thin film of offset preventing fluid, in this case high viscosity release agent liquid, applied to the surface of the roll by a dispensing apparatus described herein as applicator means 10. Because the layer of high viscosity release agent liquid upon the surface of fuser roll 16 is only on the order of microns in thickness, it is not shown in the illustration. Applicator means 10 includes a wicking assembly 2 mounted upon metal plate 4 which forms a reservoir 8 for containing a replenishable supply of the emulsion to be transported through wick 2. Although it is not shown, reservoir 8 may be provided with emulsion by pumping means which transports emulsion from a reservoir (not shown) to reservoir 8. Exemplary transport or pumping means are shown in British Pat. No. 1,399,740 and U.S. Pat. No. 3,256,002. Means for conforming applicator means 10 to the surface of fuser roll 16 are shown by the numeral 6. The support members 6 may be metal plates, for example, steel, to conform the wick to the surface of fuser roll 16.

During the operation of the fuser member illustrated in FIG. 1, the offset of toner powder upon the heated surface 22 used to fix toner powder 42 to substrate 40 when substrate 40 is in pressure engagement with heated surface 22, is prevented by applying to heated surface 22 a high viscosity release agent liquid, for example, 60,000 centistokes silicone oil, by applicator means 10 in contact with heated surface 22, applicator means 10 containing a low viscosity emulsion of the high viscosity release agent and a dispersion liquid to promote the transport of the high viscosity release agent liquid to heated surface 22 where the dispersion liquid evaporates leaving only a film of the high viscosity release agent liquid upon heated surface 22.

Although it is not shown, the vaporized dispersion liquid, for example, steam, can be removed if necessary from the area of the fuser roll by suitable venting means. Thus, the dispersion liquid is evaporated by the heat of heated surface 22 whereby substantially high viscosity release agent remains on heated surface 22 and the dispersion liquid is evaporated and escapes into the surrounding atmosphere.

Because applicator means 10 is in contact with heated surface 22, the dispersion liquid also evaporates in the area of the applicator means in contact with heated surface 22. This evaporation at the surface of applicator means 10 also promotes the application of substantially high viscosity release agent liquid to heated surface 22.

As discussed above, applicator means 10 preferably comprises wick member 2 which is heated by heated surface 22. Applicator means 10 may also comprise a pad, for example, a felt pad made of suitable heat resistant material to resist the high temperatures of heated surface 22. High temperature-resistant wick and pad materials are well known in the art and include various heat resistant, fibrous materials for example, heat resistant polyamides and the like. One preferred material is a copolymer of metaphenylenediamine and isophthaloyl chloride known commercially as Nomex, a trademark of E. I. duPont deNemours and Company of Wilmington, Del. Other heat-resistant wick materials and configurations are described in *Xerox Disclosure Journal*, Vol. 4, No. 2, March/April 1979, pp. 163 and 165.

Figure 2:
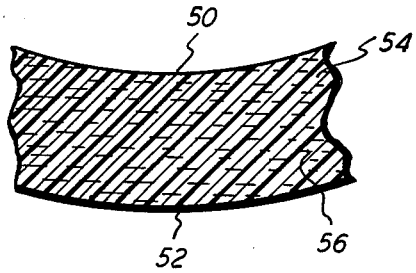
FIG. 2 is a magnified segment of the heat resistant, fibrous applicator for the contact application of fluid upon the surface of a member used to fix toner powder to a substrate.

As shown in FIG. 2, the means for removing the dispersion liquid from the low viscosity emulsion to leave a substantially high viscosity release agent liquid upon heated surface 22 is heat provided by fuser member 16. Although it is not shown, reduced pressure and combinations of reduced pressure and heat may also be used as means for removing the dispersion liquid from the emulsion. The low viscosity emulsion may be applied to applicator means 10 after applicator means 10 is inserted in the device for heat fusing toner powder to a substrate, however, in preferred embodiments, the low viscosity emulsion is pre-soaked into material 2 of applicator means 10. In certain preferred embodiments, applicator means 10 having low viscosity emulsion presoaked therein is subjected to heat, reduced pressure, or combinations thereof to reduce dispersion liquid therefrom before the applicator means is inserted into the device. As the release agent in applicator means 10 becomes depleted, it can be replenished by any suitable means including reservoir 8 shown in FIG. 2 or by any type of diffusion system which transports the emulsion into material 2 of applicator means 10. Accordingly, any supply means (not shown) for replenishing the applicator means 10 with emulsion which has been depleted therefrom, may be used in accordance with the present invention. The pre-filled applicator means provides an improved vehicle for transferring the emulsion from its source, for example, reservoir 8, to the surface 22 of fuser roll 16. The pre-soaked or pre-filled applicator means reduced of dispersion liquid evenly distributes high viscosity release agent upon the surface of the fuser member during all stages of operation.

FIG. 2 illustrates a segment of applicator means 10 which is magnified to show the emulsion therein. In FIG. 2, heat resistant, fibrous material 54, such as heat-resistant polytetrafluoroethylenes, fluorinated ethylenepropylene polymers, copolymers of meta-phenylenediamine and isophthaloyl chloride and the like, is impregnated with high viscosity release agent liquid 56 which may be in the form of an emulsion in those cases where the dispersion liquid has not been depleted from the heat resistant fibrous material. As shown in FIG. 2, surface 50 represents the surface of the heat resistant fibrous material which contacts the heated surface of a fuser member (not shown), and numeral 52 represents the surface of the heat resistant, fibrous material 54 which is remote from the heated surface of the fuser member. As heat penetrates from the surface of the fuser member into the surface of the heat resistant, fibrous material 54 at surface 50, the dispersion liquid of the emulsion is reduced by the action of the heat, and the viscosity of the release agent liquid is higher at surface 50 than at surface 52.

In accordance with the present invention, there is also provided a method of manufacturing a heat resistant, fibrous applicator for the contact application of fluid upon the surface of a heated member comprising forming the applicator in the desired configuration and thickness; applying an emulsion of a high viscosity liquid and a dispersion liquid to the applicator until the emulsion is impregnated therein; and optionally removing low viscosity dispersion liquid therefrom. The applicator may be any suitable configuration, and generally is a configuration which conforms with the surface of the fuser member which it contacts. The thickness of the applicator depends upon the quantity of release agent liquid which must be supplied to the surface of the fuser roll, the porosity and density of the fibers and various other factors which must be adjusted by one skilled in the art and which are well known in the art. The emulsion may be applied to the formed applicator by any suitable method, or the emulsion may be applied to the applicator prior to the forming of the applicator in the desired configuration. For example, the emulsion may be applied to the heat resistant fibrous material by dipping, spraying or any other suitable means. The dispersion liquid may be removed from the fibrous material after impregnation is complete by heat, by vacuum or by a combination of vacuum and heat. When heat is used alone, the temperature is generally that temperature which is sufficient to vaporize the dispersion liquid, for example 100° C. when the dispersion liquid is water. Reduced pressures at less than one atmosphere may also be used to remove the dispersion liquid.

By the foregoing method, there is provided an article comprising a heat resistant, fibrous applicator for the contact application of fluid upon the surface of a heated member, the fibrous applicator being impregnated with an emulsion of a high viscosity liquid and a dispersion liquid and thereafter, optionally reduced of dispersion liquid. The dispersion liquid may be reduced within the fibrous material, that is, not completely removed therefrom, or it may be depleted, that is, substantially all of the dispersion liquid is removed therefrom.

While the invention has been disclosed with reference to certain preferred embodiments including devices, structures and methods described herein, it will be apparent that certain modifications and changes can be made without departing from the spirit and scope of the invention, and therefore, it is intended that the foregoing disclosure be limited only by the claims appended hereto.

What is claimed is:

1. A method for preventing the offset of toner powder to a heated surface used to fix the toner powder to a substrate when the substrate is in pressure engagement with the heated surface comprising applying to the heated surface a high viscosity release agent liquid by continuously replenishable applicator means in contact with the heated surface, said applicator means in contact with a reservoir of a low viscosity emulsion of the high viscosity release agent and an inert vaporizable dispersion liquid for supplying and transporting said high viscosity release agent liquid to the heated surface.

2. The method of claim 1 wherein the inert, vaporizable dispersion liquid is evaporated by the heat of the heated surface whereby substantially high viscosity release agent remains on said heated surface.

3. The method of claim 1 further comprising heating the applicator means in contact with the heated surface to vaporize the inert vaporizable dispersion liquid whereby substantially high viscosity release agent is applied to the heated surface.

4. The method of claim 1 wherein the applicator is a wick and is heated by the heated surface.

5. The method of claim 1 wherein the high viscosity release agent is a polydimethylsiloxane.

6. The method of claim 1 wherein the inert, vaporizable dispersion liquid is water.

7. The method of claim 1 further comprising supplying emulsion to said applicator means.

8. A device for heat fusing toner powder to a substrate by containing the toner powder with a heated surface comprising:

a. means for applying pressure contact between the substrate and the heated surface;

b. continuously replenishable applicator means in contact with the heated surface for providing a substantially high viscosity release agent upon the heated surface; said applicator means being in contact with a reservoir of a low viscosity emulsion of the high viscosity release agent and an inert, vaporizable dispersion liquid for supplying and transporting said high viscosity release agent to the heated surface; and c. means for removing the inert, vaporizable dispersion liquid from the low viscosity emulsion.

9. The device of claim 8 wherein the applicator means is heated.

10. The device of claim 9 wherein the applicator means is heated by contact with the heated surface.

11. The device of claim 8 wherein the applicator means is a wick.

12. The device of claim 11 wherein said wick is heated.

13. The device of claim 8 wherein the applicator means is a pad.

14. The device of claim 13 wherein the pad is heated.

15. The device of claim 8 wherein the low viscosity emulsion is supplied to the applicator means from a reservoir.

16. The device of claim 8 wherein the low viscosity emulsion is pre-soaked into the applicator means.

17. The device of claim 16 wherein the applicator means presoaked with low viscosity emulsion is heated to remove inert, vaporizable dispersion liquid therefrom.

18. The device of claim 16 wherein the applicator means presoaked with low viscosity emulsion is subjected to reduced atmospheric pressure to remove inert, vaporizable dispersion liquid therefrom.

19. The device of claim 16 wherein the applicator means presoaked with low viscosity emulsion is subjected to reduced atmospheric pressure and heat to remove inert, vaporizable dispersion liquid therefrom.

20. The device of claim 8 wherein the low viscosity emulsion comprises a polydimethylsiloxane having a viscosity of at least 10,000 centistokes and water.

21. The device of claim 20 wherein water is present as a dispersion liquid in an amount sufficient to reduce the viscosity of the polydimethylsiloxane by at least 75%.

22. The device of claim 8 further comprising supply means for replenishing the applicator with emulsion depleted therefrom.

23. An article comprising a heat resistant, fibrous applicator for the contact application of fluid upon the surface of a heated member, said fibrous applicator being impregnated with an emulsion of a high viscosity liquid and a dispersion liquid and thereafter reduced of dispersion liquid.

24. The article of claim 23 further comprising depletion of the dispersion liquid.

25. The article of claim 23 wherein the fibrous applicator is a heat resistant copolymer of metaphenylenediamine and isophthaloyl chloride.

26. The article of claim 23 wherein the high viscosity liquid comprises a polydimethylsiloxane.

27. The article of claim 23 wherein the dispersion liquid is water.

28. The article of claim 23 wherein the dispersion liquid is reduced in the applicator by heat, by vacuum or by a combination of heat and vacuum.

* * * * *